United States Patent [19]

Suman, Jr.

[11] 4,440,226

[45] Apr. 3, 1984

[54] WELL COMPLETION METHOD

[76] Inventor: George O. Suman, Jr., 4200 Westheimer Rd., Suite 211, Houston, Tex. 77027

[21] Appl. No.: 447,873

[22] Filed: Dec. 8, 1982

[51] Int. Cl.[3] ..... E21B 33/13; E21B 33/127

[52] U.S. Cl. ..... 166/250; 166/285; 166/187

[58] Field of Search ..... 166/187, 250, 253, 281, 166/285, 289

[56] References Cited

U.S. PATENT DOCUMENTS

| | | | |
|---|---|---|---|
| 3,666,011 | 5/1972 | Owens | 166/187 |
| 3,918,522 | 11/1975 | Suman, Jr. | 166/289 |
| 3,948,322 | 4/1976 | Baker | 166/289 |
| 4,155,404 | 5/1979 | Hollingsworth | 166/187 |

*Primary Examiner*—Stephen J. Novosad
*Assistant Examiner*—William P. Neuder

[57] ABSTRACT

Disclosed is a method for reducing or preventing migration of a formation fluid from a first earthen formation to a second earthen formation each of which is intersected by a drilled borehole. The method includes running into the borehole, the packer includes a mandrel with a plastic sleeve there about and a valve for permitting the flow from the interior of the mandrel into the interior of the sleeve to expand the sleeve against the formation. The method further includes the steps of determining each of the pressures of the formation, the radial shrinkage of the cement within the sleeve, and the maximum pressure which can be exerted by the sleeve on the formation without fracturing same. The method further includes the step of pumping cement down through the casing and mandrel and into the sleeve at a pressure less than the maximum pressure that can be exerted on the formation without fracturing same, but sufficient to resiliently strain the mandrel, sleeve, and formation in an amount sufficiently greater than the shrinkage of the cement during setting to provide a pressure of the sleeve against the formation after the cement has set, greater than the pore press of the formation.

4 Claims, 3 Drawing Figures

WELL COMPLETION METHOD

BACKGROUND OF THE INVENTION

This invention relates to a method for completing wells and especially to a method for preventing migration of formation fluids from one formation to another through the use of special cementing techniques.

In the completion of wells, it has long been conventional to pump cement down through the casing to flow back up through the casing-borehole annulus to a selected height after which it is permitted to set. This is usually referred to as a "primary cement job". One important goal sought to be achieved in a successful primary job is to create a permanent, fluid-tight seal against vertical fluid communication along the casing-borehole annulus, both before and after perforating. Because the borehole penetrates natural barriers to vertical flow such as shale breaks or otherwise impermeable strata between permeable zones, the cement sheath in the annulus must act in place of those barriers when a differential presssure exists across them. Pressure differential may be induced across barriers either by increasing or decreasing pore pressure relative to that of adjacent zones, or such differentials may exist naturally between normal and geopressure strata. For optimum performance of cased hole completions, interzonal communication between differentially pressured strata is undesirable. Interzonal flow can cause the loss of valuable hydrocarbons, the failure of stimulation treatments, and other problems. Assuming that the cement is impermeable, there are two possible paths for flow between zones or formations. One such path that could develop to allow fluids to move vertically is along the casing-cement interface. Another possible and more probable path is the cement-formation interface. Such flow from one zone formation to another is commonly called "migration."

A recent study has indicated that the failure of a so-called "cement-formation" bond may be a major cause for unsuccessful primary cementing jobs. See "Field Measurements of Annular Pressure and Temperature During Primary Cementing" by C. E. Cooke, Jr., M. P. Kluck and R. Medrano, Society Petroleum Engineers Paper No. 11206, presented at the 57th Annual Fall Technical Conference, New Orleans, La., Sept. 26–29, 1982. Thus, it is indicated that at a particular depth in a well, the hydrostatic pressure exerted by the cement against the formation decreases as the cement cures. Cement, like drilling muds, has thixotropic properties so that after it stops flowing, it develops gel strength so that the column of cement tends to become self supporting, due in part to its frictional engagement with the borehole wall. As a result, when the cement undergoes curing and concurrent shrinkage, the pressure exerted by the cement against the face of the borehole decreases to a point such that the cement does not have sufficient contact with the wall to form a seal therewith. Fluid from a formation can flow or migrate upwardly, for example, through a micro-annulus between the borehole wall and the cement to an upper lower pressure formation or even to the surface of the well. As a result, there can be interzonal fluid communication along the micro-annulus in the direction of a lower pressure zone, be it above or below the zone of interest.

It is therefore an object of this invention to provide a method for isolating one formation from another in a manner such that the shrinkage of cement does not reduce the seal load on the formation to such an extent that migration can occur.

DETAILED DESCRIPTION OF THE INVENTION

Figure 1:
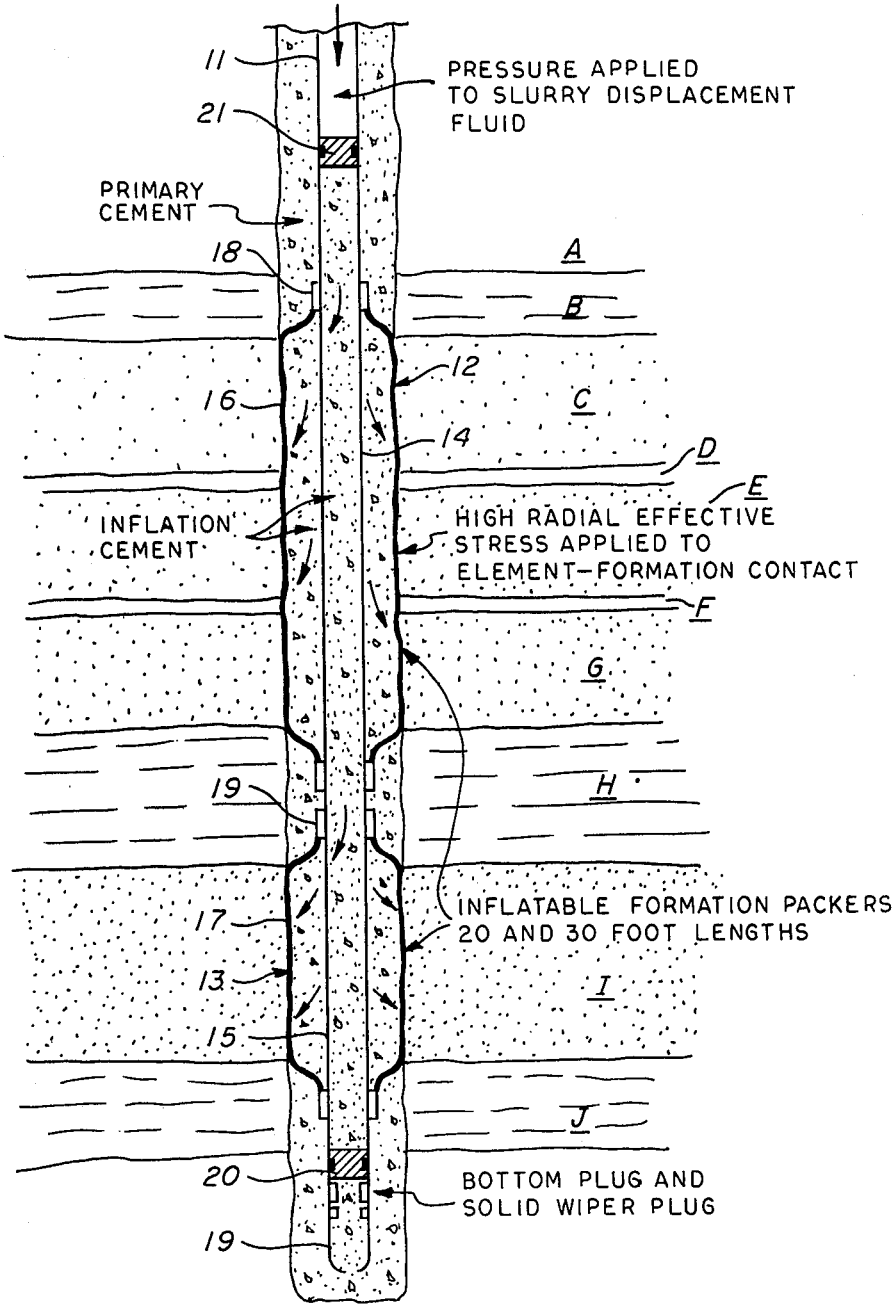
FIG. 1 is a schematic vertical cross-sectional view of a borehole illustrating one embodiment of apparatus which can be used to practice the method of this invention.

Referring to FIG. 1, there is shown a borehole 10 which has been drilled through several formations such as A through J. A conventional casing 11 has been run into the borehole with conventional inflatable packers 12 and 13 made up as part of the casing string.

Each of the packers includes a mandrel 14 and 15, respectively, which is made up as a part of the casing string by suitable joints (not shown). Each packer also includes an outer elastic sleeve (usually rubber) 16 and 17, respectively, surrounding the mandrel and sealed thereto at their respective ends. Each of the packers also includes a valve means 18 and 19, respectively, for permitting flow of cement from the interior of the mandrels to the interior of the rubber sleeve to expand the same laterally against a formation as shown in FIG. 1. It will be understood that while the packers are being run into the hole, the rubber sleeve is collapsed to lie immediately adjacent the mandrel. As stated, the packers can be of conventional construction and are well known to those skilled in the art. In this particular application, the mandrels are relatively long, as for example, 20 to 40 feet. For this reason, and others, it is preferred that the conventional reinforcement for the rubber not extend from end to end of the sleeve because then the reinforcement assumes part of the loading which part is not applied against the borehole. When the rubber sleeve is not reinforced along a substantial portion of its length intermediate its ends, the reinforcement does not take any of the load so that substantially all of the load on the sleeve is supported by the borehole.

When the casing string is run into the hole, the packers are located opposite the formations to be isolated. For example, upper packer 16 can be used to isolate zones C, E, and G from each other, the zones being illustrated as separated by impermeable (i.e. shale) zones D and F.

After the uninflated packers have been so located, primary cement is pumped down the casing out through a conventional casing shoe 19 for flow upwardly through the casing-borehole annulus to a desired height. This primary cement is separated from inflation cement by plug 20. When this plug lands on bottom, the casing contains inflation cement above it separated by a plug 21 from a slurry displacement fluid. Thus, after plug 20 lands, pressure can be applied through the displacement fluid to increase the pressure of inflation cement and cause it to flow outwardly into the rubber sleeves to inflate them and move them outwardly into engagement with the surrounding formation. As will be explained later, the pressure to which the packers are expanded is determined to accomplish the objects of this invention.

Figure 2:
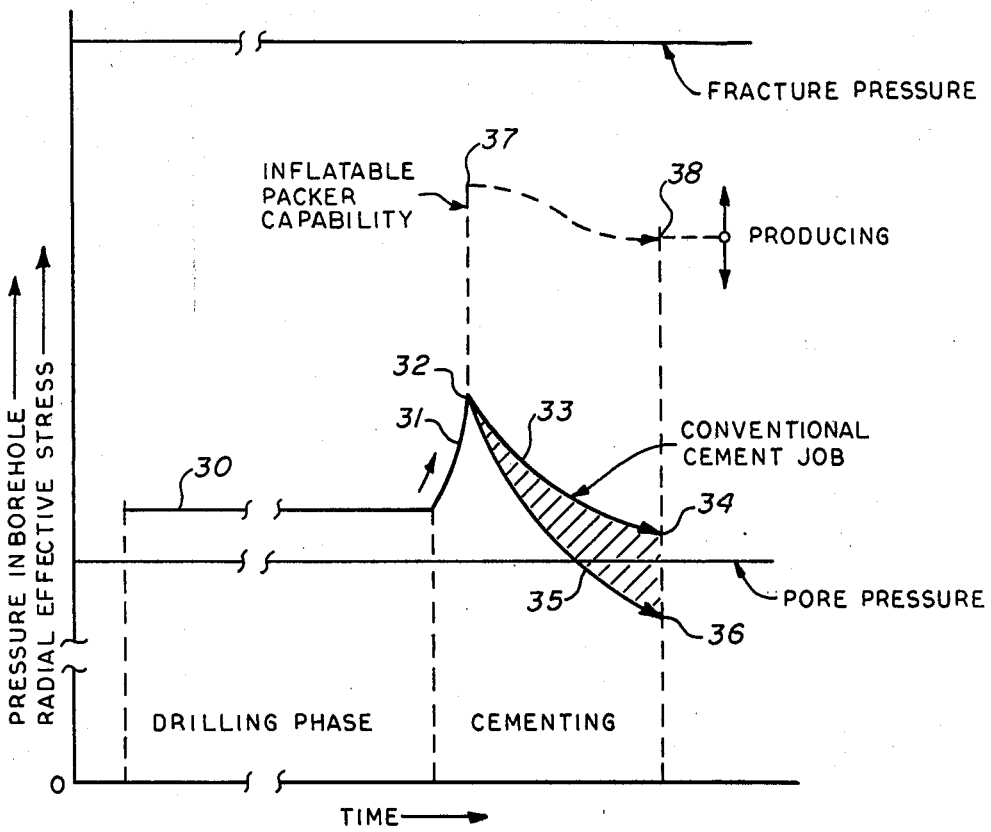
FIG. 2 is a diagram illustrating some of the concepts of this invention in comparison with the prior art.

Referring now to FIG. 2, there is illustrated the relationship of various pressures and stresses during the drilling and completion of a discrete limited section of formation downhole. The formation, prior to and after drilling, has a "pore pressure" which is the pressure of the gas or liquid hydrocarbons trapped in the formation. During the drilling of the formation, the hydrostatic head of the drilling mud exerted against the formation is adjusted to be somewhat higher than the pore pressure in order to prevent flow of formation fluids into the borehole. This hydrostatic mud pressure is illustrated by the line 30 during the drilling phase of the operation. When conventional cementing begins, the cement will flow down the casing and then upwardly through the casing-borehole annulus until it reaches the particular formation illustrated. As it so flows, it displaces drilling mud above this formation and as the cement moves upwardly past the formation, the borehole pressure exerted against the formation increases since the specific gravity of the cement is greater than that of the drilling mud. As a result, the borehole pressure increases as illustrated by the line 31 until pumping stops at which time the borehole pressure will reach its maximum as at 32. As the cement cures, it shrinks and exerts less and less pressure against the borehole wall as indicated by the line 33. In this particular case, the borehole pressure against the formation, or the radial effective stress, is indicated to be at the point 34 which is somewhat above the pore pressure. If the radial effective stress could always be maintained at the point 34, the primary cement job could termed satisfactory. However, such may not be possible. For example, subsequent formation treatment, such as acidizing, may cause the effective pore pressure at the face of the borehole to rise above point 34 in which case the treating fluid would likely migrate up a micro-annulus between the cement and the borehole face.

In some cases, the cement shrinkage can be such that the radial effective stress of the cement against the borehole wall will follow line 35 during curing with an ultimate radial effective stress as indicated at point 36. Since this is below pore pressure, there is no effective seal between the cement and a borehole face and migration of formation fluids upwardly through micro-annulus can proceed.

In accordance with this invention, cement is pumped down the casing and into the rubber sleeve at a pressure which is less than that required to fracture the formation but which is sufficient to resiliently strain the mandrel, rubber sleeve and formation an amount sufficiently greater than the shrinkage of the cement during curing to provide a pressure of the sleeve against the formation, after the cement has cured, greater than the pore pressure of the formation. Thus, referring to FIG. 2, cement is pumped into the packer until the pressure at point 37 is reached after which pumping ceases and the cement is allowed to cure in the packer. In doing so, it may shrink somewhat but even so, the packer will exert a pressure against the formation as at point 38 which is substantially above the pore pressure.

Figure 3:
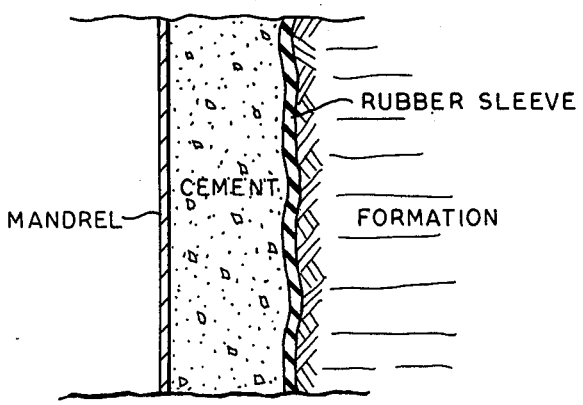
FIG. 3 is an enlarged cross-section taken through the packer and formation.

Referring now to FIG. 3, the pressure of the cement within the sleeve, prior to curing, will not only push the rubber sleeve out into tight engagement with the formation but will actually compress both the rubber sleeve and the formation in a resilient manner so that any shrinkage of the cement is compensated by the rubber of the sleeve tending to expand against the formation and by the formation itself tending to expand and decrease the diameter of the borehole. Also, the pressure of the cement will exert a collapsing force on the mandrel itself which upon the cement shrinking, will apply a force on the cement tending to move it outwardly against the rubber sleeve and maintain the latter's contact with the formation to be at a pressure above the pore pressure of the formation. Thus the sum of the radial elastic compression of the mandrel, the radial elastic compression of the sleeve and the radial elastic compression of the formation should exceed the radial shrinkage of the cement upon curing by an amount such that the pressure of the sleeve against the formation after the cement has cured exceeds the pore pressure of the formation.

The pore pressure of a particular formation can be readily determined by methods known to those skilled in the art such as drill stem testing. The fracture pressure, that is, the radial effective stress exerted by the packer against the formation to cause it to fracture, likewise can be determined by means known to those skilled in the art. For example, see the article "Fracture Gradient Prediction and its Application in Oil Field Operations" by Ben A. Eaton, Journal of Petroleum Technology, October 1969 at pages 1353 et seq. The amount of shrinkage of oil well cements during curing is well known and is usually in the range of 0.2 to 2 volume percent. For example, see the article "Study of Factors Causing Annular Gas Flow Following Primary Cementing" by John M. Tinsley et al, Society of Petroleum Engineers Paper No. 8257, 1979.

In determining the radial dimensions mentioned above, there may be instances where the downhole temperature at the packer changes during cementing or during curing of the cement or later. The effect of these temperature changes on the stressing of the formation by the rubber sleeve, etc. can be readily calculated from existing data. See for example, "Cementing Steam Injection Wells in California", by J. E. Cain et al, Journal Petroleum Technology, April, 1966. Also, for determining the expansion of the borehole due to pressure applied thereto by the packer, see for example the text entitled "Soil Mechanisms", John Wiley & Sons, 1969.

What is claimed is:

1. A method for reducing or preventing migration of a formation fluid from a first earthen formation to a second earthen formation each of which is intersected by a drilled borehole comprising the steps of connecting an inflatable packer in a string of casing and running the casing and packer into the borehole until the packer is above or opposite one of said formations; said packer including a tubular mandrel connected as part of the casing string, an outer elastic sleeve surrounding the mandrel and sealed thereto at its ends and valve means for permitting the flow of cement from the interior of the mandrel into the interior of the sleeve to expand same laterally against said one formation; determining the approximate setting shrinkage of cement filling said sleeve and expanding it out against said one formation; determining a maximum pressure for uncured cement in said sleeve which is below that which will cause said one formation to fracture; flowing sufficient cement through said valve means into said sleeve to expand it outwardly into sealing engagement with said one formation and to cause the pressure of the uncured cement in the sleeve to be below said maximum pressure but sufficient that the sum of (a) the radial elastic compression of the mandrel, (b) the radial elastic compression of said sleeve and (c) the radial elastic compression of said formation exceeds the radial shrinkage of said cement upon setting by an amount such that the pressure of said sleeve against said one formation after said cement has set exceeds the pore pressure of said formation.

2. The method of claim 1 wherein the packer is located across the formation from which migration is to be prevented.

3. The method of claim 1 wherein the packer is located above the formation from which migration is to be prevented.

4. A method for reducing or preventing migration of a formation fluid from a first earthen formation to a second earthen formation each of which is intersected by a drilled borehole comprising the steps of:

A. running an inflatable packer in a string of casing into the borehole to be opposite one of said formations; the packer having a mandrel connected as a part of the casing string, an outer elastic sleeve surrounding the mandrel and sealed thereto at its ends and having an unreinforced portion between its ends, and valve means for permitting flow of cement from the interior of the sleeve into the interior of the sleeve to expand the same against said one formation;

B. determining the pore pressure of said one formation;

C. determining the radial shrinkage of cement within said sleeve;

D. determining the maximum pressure which can be exerted by said sleeve on said one formation without fracturing same;

E. pumping cement down through said casing and mandrel into said sleeve at a pressure less than said maximum pressure but sufficient to resiliently strain said mandrel, sleeve and formation an amount sufficiently greater than the shrinkage of said cement during setting to provide a pressure of said sleeve against said one formation, after the cement has set, greater than the pore pressure of said one formation.

* * * * *